US006216713B1

(12) United States Patent
Kennan

(10) Patent No.: US 6,216,713 B1
(45) Date of Patent: Apr. 17, 2001

(54) SUPPORT DEVICE HAVING INTERCHANGEABLE TIPS

(76) Inventor: Sean A. Kennan, 3250 N. Lakewood Ave., Chicago, IL (US) 60657-3202

( * ) Notice: Subject to any disclaimer, the term of this patent is extended or adjusted under 35 U.S.C. 154(b) by 0 days.

(21) Appl. No.: 09/479,586

(22) Filed: Jan. 7, 2000

(51) Int. Cl.[7] ..... A35B 9/04

(52) U.S. Cl. ..... 135/78; 135/77; 248/188.4; 248/188.9

(58) Field of Search ..... 135/77–81; 248/188.4, 248/188.9

(56) References Cited

U.S. PATENT DOCUMENTS

| | | | |
|---|---|---|---|
| 1,061,397 | * | 5/1913 | Newell . |
| 2,376,282 | * | 5/1945 | Schroeder . |
| 2,437,076 | * | 3/1948 | Clemens . |
| 2,667,885 | * | 2/1954 | Prete . |
| 3,177,884 | * | 4/1965 | Thro . |
| 3,901,258 | * | 8/1975 | Montgomery . |
| 3,949,773 | | 4/1976 | Marescalco . |
| 4,434,808 | | 3/1984 | Burak . |
| 4,708,154 | | 11/1987 | Edwards . |
| 4,964,430 | | 10/1990 | Janis . |
| 4,977,914 | | 12/1990 | Smerker . |

FOREIGN PATENT DOCUMENTS

| | | | | |
|---|---|---|---|---|
| 75112 | * | 6/1917 | (CH) | 135/78 |
| 84368 | * | 6/1917 | (CH) | 135/78 |

* cited by examiner

*Primary Examiner*—Robert Canfield
(74) *Attorney, Agent, or Firm*—Leydig, Voit & Mayer, Ltd.

(57) ABSTRACT

A traction assembly that may be coupled to the distal of the leg of a mobility assisting device such as a cane, crutch, or walker. The distal end of the leg is provided with a threaded rod which extends axially from the end thereof. Interchangeable foot or spike/sleeve assemblies are alternately threaded onto the axially, outwardly extending rod. The threaded rod is designed to be of a precision length such that when it is completely assembled, the distal end of the rod comes into direct force contact with the head of the spike protruding from the end of the threaded sleeve, directing all of the force to the absolute center or axis of the tubular material of the cane, crutch, or walker.

20 Claims, 4 Drawing Sheets

SUPPORT DEVICE HAVING INTERCHANGEABLE TIPS

FIELD OF THE INVENTION

This invention relates generally to support or assistance devices such as canes, crutches, or walkers, and more specifically to support devices specifically adapted to be used on various types of surfaces.

BACKGROUND OF THE INVENTION

Mobility assisting devices such as canes, crutches, and walkers are used by many people on both temporary and permanent bases. Generally, such devices have tubular lower leg portions, having a rubber foot, or the like, disposed at the distal end. While these devices may be readily used during fair weather conditions, use of such devices is particularly difficult during inclement weather conditions. This is particularly true in snowy and icy conditions as the leg or legs may not maintain a firm footing.

Various modifications have been proposed to enhance the grip of such devices on slippery surfaces, with varying degrees of success. Examples of such proposals are disclosed in the following patents: U.S. Pat. No. 3,949,773 to Marescalco; U.S. Pat. No. 4,434,808 to Burak; U.S. Pat. No. 4,708,1154 to Edwards; U.S. Pat. No. 4,964,430 to Janis; U.S. Pat. No. 4,977,914 to Smerker; and U.S. Pat. No. 5,056,546 to Sharp. The devices disclosed in the Burak, Smerker, and Sharp patents disclose devices intended to provide retractable gripping arrangements. These devices are relatively complex, however, comprising spring-loaded extension/retraction arrangements which may be relatively expensive to manufacture and assemble. In addition, they are highly susceptible to breakage due to the a high number of moving parts.

The references to Janis, Marescalco, and Edwards each disclose tips having circular tip members with multiple teeth. The Janis and Marescalco references disclose a toothed gripping member constructed similarly to a circular hole saw. This circular arrangement of gripping teeth, however, can result in the bending and possibly breakage of one or more teeth as the user applies a force to the tip during usage, particularly when the force is applied in any direction other than absolutely normal to the ground. The cleat of Marescalco, which is stamped from a flat piece of metal and then the four toothed legs bent to a right angled position, is particularly susceptible to deformation during normal use.

Janis attaches the toothed gripping member to the shaft by a screws extending through the member and the shaft, or by a band which extends around the leg and likewise is tightened by screw arrangement. There is potential for the tip to slip from the leg in the case of the use of a band. In either arrangement, the coupling screw may not be readily tightened or loosened without a separate tool, rendering it difficult to utilize the toothed gripping member. Accordingly, Janis proposes an arrangement wherein two canes, for example, are coupled side by side, one being inverted. One of the canes would have a standard distal tip, while the other would have the toothed gripping member such that the user could utilize the appropriate cane for the environment. This arrangement can be expensive, heavy and cumbersome in that it requires the use of two support devices. Even in arrangements incorporating a single shaft with the different tips disposed at opposite ends, use of the device disposes the opposite, potentially soiled or sharp tip adjacent the user's limbs and/or body.

Marescalco attaches the cleat to the leg by coupling the cleat to the standard rubber elastomeric cup-shaped tip, which is removed from the leg for attachment of the cleat assembly, and then replaced on the leg. This may be reversed for removal of the cleat assembly. Alternately, a separate cup-shaped elastomeric tip may be placed over the cleat assembly to utilize the support device on a floor or finished surface. Elastomeric tips of this sort, however, are subject to degradation due to use or environmental conditions. The degradation of elastomeric cup-type tips is prevalent when such tips are repeatedly elastically or plastically deformed, as when the tip is removed or reassembled to the leg or the cleat. The elastomeric tip coupling the cleat assembly to the shaft is particularly susceptible to such degradation due to both environmental and use conditions. As a result, the relative positions of the cleat assembly and leg may shift during use, resulting in uncertain footing to the user and ultimate failure of the attachment.

The foot assembly of Edwards likewise will not provide firm footing to the user. The Edwards disk-shaped foot includes a pad having a plurality of somewhat rounded flexible, resilient fingers extending from its lower surface. Contrary to the representations made in Edwards, it is unlikely that resilient and flexible fingers such as this will provide firm footing on wet or icy surfaces. Further, an elastomeric material, such as would be used in the Edwards device, would not likely provide added traction over conventional elastomeric cup-type tips.

DMI DURO-MED Industries, Inc., of Hackensack, N.J., also markets a adapter which may be bracketed to the distal tip of a leg such that it may be unlatched and pivoted between a position below the rubber tip of the leg and a position along the side of the leg. The adapter includes a washer shaped element from which five teeth or prongs depend, similarly to a circular hole saw. The washer with prongs is supported on a bent wire. As with the Janis and Marescalco references, the prongs of the washer-shaped element are susceptible to bending and deformation due to the forces exerted during normal usage, as is the supporting wire. Additionally, the particular geometry of the DMI device prevents the application of force directly along the axis of the leg. Rather, an application of force to the leg results in moments which are applied along the bent wire, enhancing the likelihood of failure of the device due to plastic deformation of the wire, or failure of attachment points of the wire.

OBJECTS AND SUMMARY OF THE INVENTION

Accordingly, it is a primary object of the invention to provide an assembly that may be coupled to the distal end of a leg whereby the rubber foot of the leg may be exchanged by a friction increasing element, such as a spike or other pointed structure.

It is another object of the invention to provide mobility assisting devices which may be more readily utilized in inclement weather conditions, and in snow and ice in particular.

An additional object is to provide a traction enhancing device that may be quickly and easily exchanged for a conventional tip by the user.

It is a further object of the invention to provide a traction enhancing arrangement for mobility assistance devices which may be economically manufactured.

Yet another object is to provide a stable, durable device.

In keeping with these and other objects of the invention, there is provided a traction assembly that may be coupled to the distal of the leg of a mobility assisting device such as a cane, crutch, or walker. The distal end of the leg is provided with a threaded rod or "stud" which extends axially from the end thereof. The threaded rod may be welded or formed directly to the end of the leg, or, preferably, threaded directly into the steel tubing of a cane or an insert disposed within the end of the leg. Interchangeable foot or spike/sleeve assemblies are then threaded onto the axially, outwardly extending rod. In this way, when the user encounters inclement weather conditions, he may unscrew the foot assembly from the axially extending threaded rod and, in its place, screw the spike assembly onto the leg. When again moving indoors or when the inclement weather has ceased, the spike assembly may be easily and quickly exchanged out for the foot assembly.

The threaded rod is designed to be of a precision length such that when it is completely assembled, the distal end of the rod comes into direct contact with the head of the spike protruding from the end of the threaded sleeve. Accordingly, all of the force is directed to the absolute center or axis of the tubular material of the cane, crutch, or walker. This feature provides the user with better control in the event of a loss of balance and increased "one-to-one" communication with the surface upon which he or she is traveling.

Additional objects, advantages and other novel features of the invention will be set forth in part in the description that follows and in part will become apparent to those skilled in the art upon examination of the following or may be learned with the practice of the invention.

DESCRIPTION OF THE PREFERRED EMBODIMENT

Figure 1:
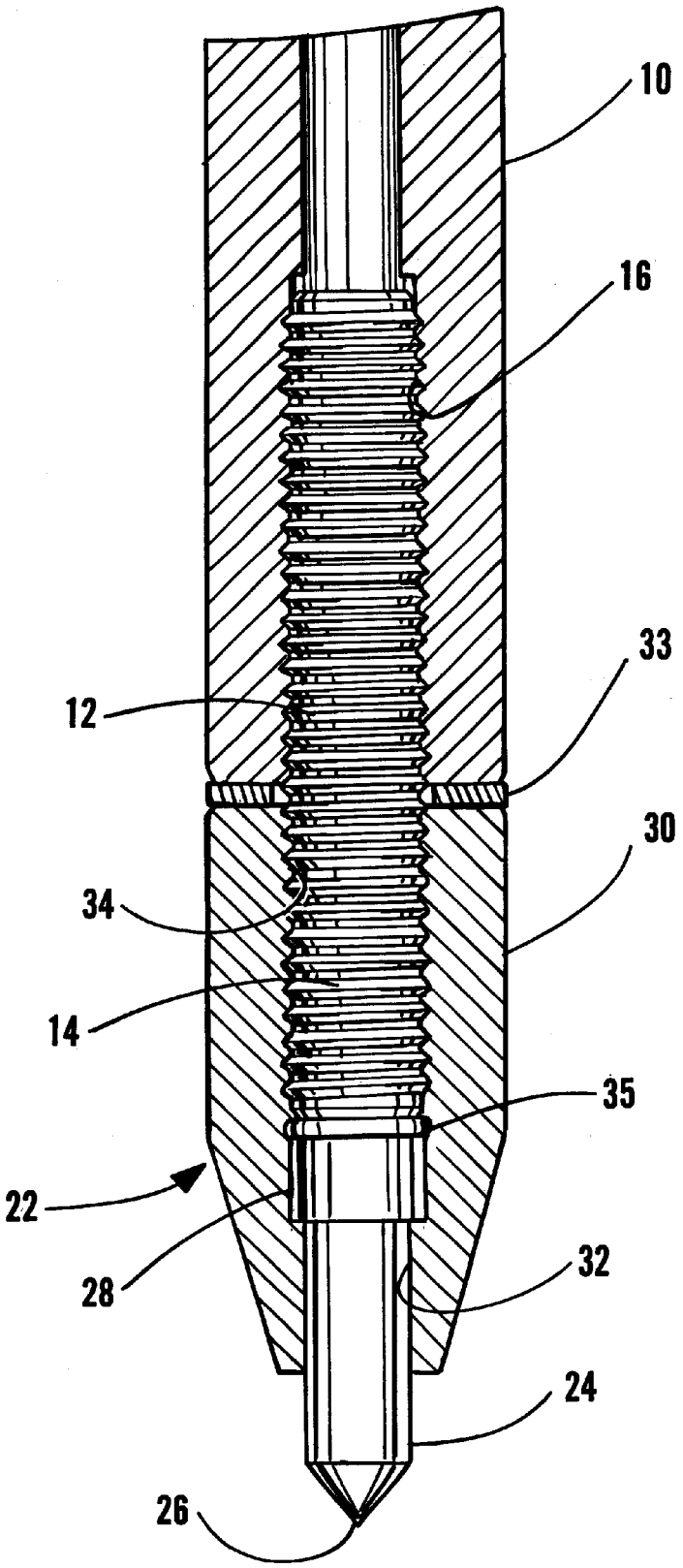
FIG. 1 is a longitudinally extending cross-sectional view of the end of a leg of a mobility assisting device constructed in accordance with the teachings of the invention and including a spike assembly.
Figure 4:
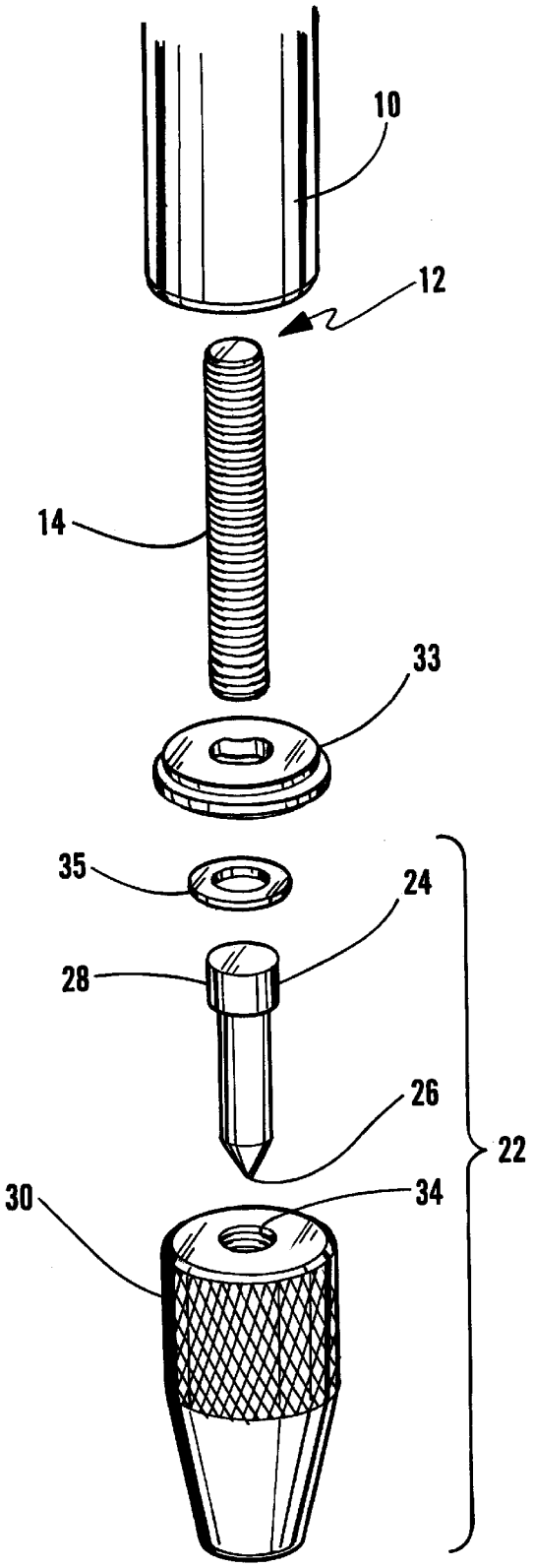
FIG. 4 is an exploded view of the device of FIG. 1.

Turning now the drawings, there is shown in FIGS. 1 and 4, the end of a typical leg 10 of a mobility assisting device. In the embodiment shown in FIGS. 1 and 4, the leg 10 is constructed of cane steel tubing, although an alternate construction may be provided.

In accordance with the invention, the end of the leg 10 is provided with an attachment assembly 12 whereby a distal end portion having enhanced grip on slippery surfaces may be coupled to the cane (as explained below), a crutch, a walker, or the like. The attachment assembly 12 comprises a threaded rod 14 which extends axially outward from the distal end of the leg 10. In the embodiment illustrated in FIGS. 1 and 4, the leg 10 is configured such that the threaded rod 14 is threaded directly into an axially extending bore 16 in the end of the leg 10. It will be appreciated by those of skill in the art that this arrangement is appropriate when the wall of the leg 10 is sufficiently thick permit to such direct connection. Alternately, the threaded rod 14 might be coupled to the leg 10 by welding or may be formed integrally with the leg 10 itself.

Figure 3:
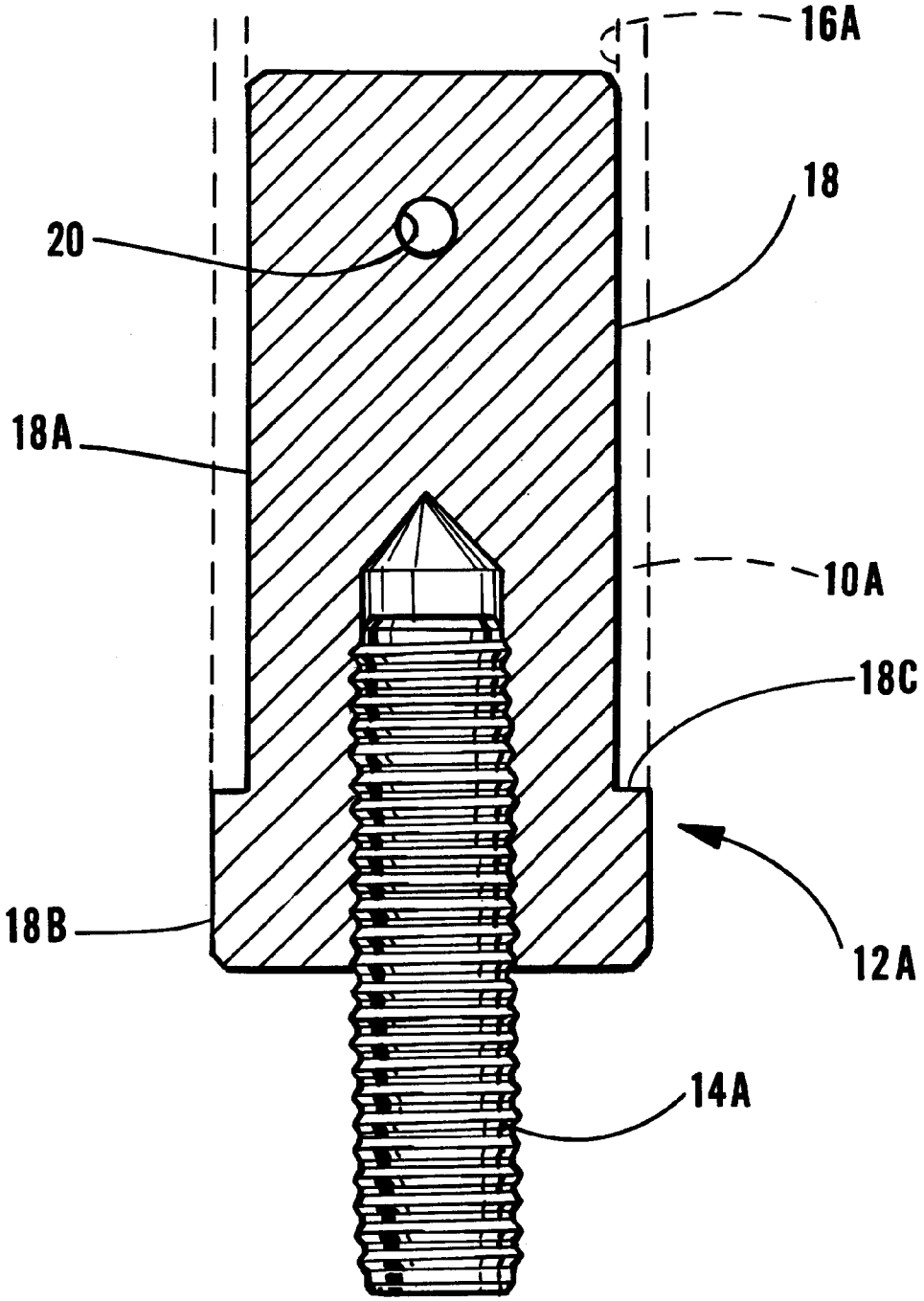
FIG. 3 is an alternate embodiment of an attachment assembly for attaching the spike or foot assemblies of FIGS. 1 and 2 to the end of the leg of a mobility assisting device, the leg being shown in phantom.

When the leg 10A includes a relatively thin wall, the attachment assembly 12A may further comprise an insert 18, such as is illustrated in FIG. 3, from which the threaded rod 14A extends. Preferably, the threaded rod 14A is disposed coincident with the longitudinal axis of the leg 10A, as with the embodiment illustrated in FIGS. 1 and 4. In this way, the attachment assembly 12A illustrated in FIG. 3 presents a threaded rod 14A as is presented in the embodiment illustrated in FIG. 1 and is utilized in the same manner as described with regard to FIGS. 1 and 4.

In order to facilitate assembly to the leg 10A and to enhance durability, the insert 18 preferably includes a small diameter portion 18A, which may be received within the bore 16A, and a flange 18C which is disposed subjacent the lower surface of the leg 10A when so received within the bore 16A. Accordingly, during use, the force is applied evenly from the leg 10A to the flange 10C. For cosmetic purposes, the portion 18B of the insert 18 extending from the leg 10A preferably has the same outer diameter as the outer diameter of the leg 10A. The insert 18A may be coupled to the leg 10A by any appropriate means. For example, a screw or pin (not shown) may be received through openings 20 in the leg 10A and insert 18 to couple the attachment assembly 12A to the leg 10A.

Returning now to FIGS. 1 and 4, to enhance traction during usage, the mobility assisting device is further provided with a spike assembly 22 which may be coupled to the axially extending threaded rod 14. The spike assembly 22 comprises a spike 24 having a relatively pointed distal end 26 and an enlarged proximal end 28 or head. In order to retain the spike in its axially extending relationship shown in FIG. 1, a collar or spike retainer 30 having an axially extending bore 32 receives the spike 24. It will be appreciated that the enlarged proximal end 28 of the spike 24 is of a greater diameter than the most distal end of the bore 32, such that the spike 24 is maintained in position within the bore 32. Those skilled in the art will appreciated that with the spike assembly 22 illustrated, the user may easily replace the spike 24 itself if a less pointed spike or other structure is desired.

On order to couple the spike assembly 22 onto the leg 10, the axially extending bore 32 of the spike retainer 30 is threaded at its proximal end 34. In use, the user screws the spike retainer 30 containing the spike 24 onto the threaded rod 14, the threaded rod being received in the threaded bore 34 to secure the spike assembly 22 to the leg 10. According to an important feature of the invention, the distal end of the threaded rod 14 comes into direct force contact with the enlarged proximal end 28 of the spike 24. Thus, these components are preferably of precision dimensions. A washer or the like 35 may be provided to assist in maintaining the spike assembly 22 securely to the leg 10 or to provide a certain level of cushioning between the spike 24 and the threaded rod 14.

To assist in maintaining the spike assembly 22 in a secure position on the end of the leg 10 and prevent the assembly 22 from wearing loose as the user travels, a washer 33 is preferably disposed about the threaded rod 14 between the distal end of the leg 10 and the proximal surface of the spike retainer 30. In the currently preferred embodiment, a steel neoprene lined washer is utilized. A neoprene lined washer is particularly effective for users whose upper body strength is limited and may have difficulty hand tightening the respective components. Other spring type lock washers may be substituted, however, if limited upper body strength is not an issue for the user.

Figure 2:
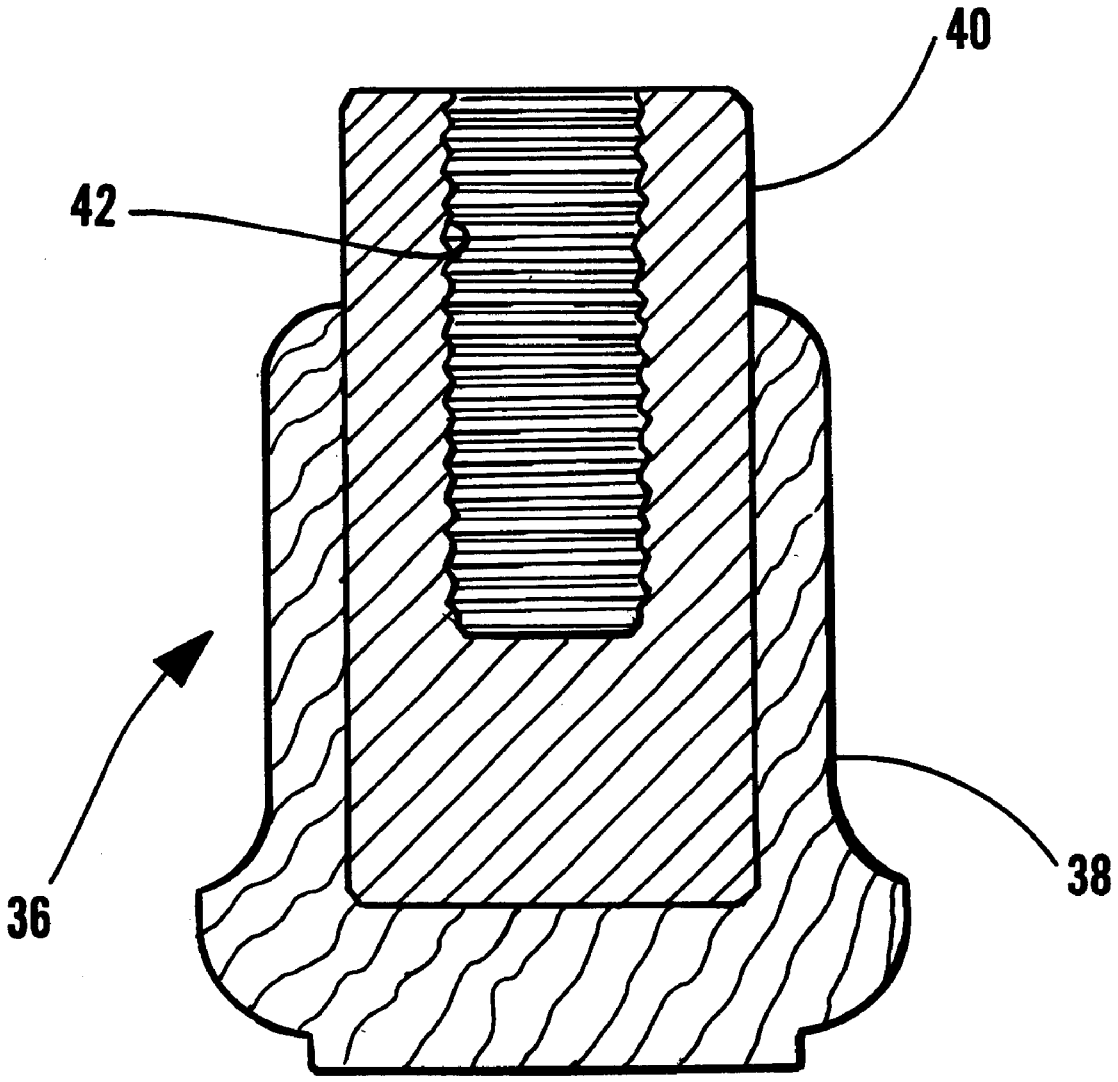
FIG. 2 is a cross-sectional view of a foot assembly for use with the leg assembly illustrated in FIG. 1.

Turning now to FIG. 2, according to an important feature of the invention, a foot assembly 36 may be exchanged for the spike assembly 22 of FIG. 1 when the mobility assisting device is used indoors or on finished surfaces. In the preferred embodiment of the foot assembly 36, a rubber foot 38 is disposed on a rubber foot retainer 40. As with the spike retainer 30, the rubber foot retainer 40 is provided with an axially extending threaded bore 42 for receiving the threaded rod 14 to couple the foot assembly 36 to the leg 10.

The spike 26, spike retainer 30, rubber foot retainer 40, insert 18, and threaded rod 12 are preferably formed of steel or the like, at least the spike 26 preferably being formed of a hardened steel. In order to enhance manipulation of the interchangeable end assemblies, the spike retainer 30 and the foot assembly 36 are preferably knurled along their outer surfaces, as may be seen in FIG. 4.

While the invention has been explained with regard to a threaded rod extending axially from the distal end of the leg 10, it will be appreciated by those skilled in the art that an alternate attachment means may be provided. For example, the leg 10 may be provided with an internally threaded bore which receives a threaded rod coupled to the foot assembly or spike assembly.

I claim:

1. A reduced-slip mobility assisting device comprising:

at least one leg having an axis:

a threaded rod having a distal end extending from the leg along said axis;

a collar having a proximal end and a distal end, and an internal bore extending axially therethrough, said internal bore being internally threaded along the collar proximal end, said threaded portion of said bore being adapted to receive the distal end of the threaded rod;

a spike having a relatively pointed distal end, and an enlarged proximal end, said proximal end of said spike being adapted to be received in and retained by the distal end of the collar such that the pointed distal end of the spike extends outward from the collar whereby the spike inhibits slippage of the leg against a surface.

2. The reduced-slip mobility assisting device of claim 1 wherein the leg includes an internally threaded bore and the threaded rod includes a proximal end, the proximal end being adapted to be received in the internally threaded bore of the leg.

3. The reduced-slip mobility assisting device of claim 1 wherein the threaded rod is welded to the leg.

4. The reduced-slip mobility assisting device of claim 1 wherein the threaded rod is integrally formed with the leg.

5. The reduced-slip mobility assisting device of claim 1 further comprising an insert, said leg having an internal bore adapted to receive the insert, said threaded rod extending axially from said insert.

6. The reduced-slip mobility assisting device of claim 5 wherein the insert is copuled to the leg by an interference fit.

7. The reduced-slip mobility assisting device of claim 5 further comprising a pin, the leg further comprising a radial bore, and the insert further comprising a complementary radial bore, the pin being received in the radial bores of the leg and the insert to couple the insert to the leg.

8. The reduced-slip mobility assisting device of claim 7 wherein the at least one of the radial bores is threaded and the pin comprises complimentary threading such that the threaded radial bore receives the threaded pin to couple the insert to the leg.

9. The reduced-slip mobility assisting device of claim 1 wherein the collar has an outer peripheral surface, said outer peripheral surface being knurled.

10. The reduced-slip mobility assisting device of claim 1 further comprising a washer, said washer being disposed about the threaded rod between the leg and the collar.

11. The reduced-slip mobility assisting device of claim 10 wherein the washer comprises a resilient material.

12. The reduced-slip mobility assisting device of claim 11 wherein the washer is a neoprene lined steel washer.

13. The reduced-slip mobility assisting device of claim 1 wherein the spike is hardened steel.

14. The reduced-slip mobility assisting device of claim 1 wherein the collar bore includes an internal flange, and the enlarged proximal end of the spike includes a substantially radially-extending surface, said radially-extending surface engaging the internal flange when the spike is received within the distal end of the internal bore of the collar.

15. The reduced-slip mobility assisting device of claim 1 wherein the threaded rod includes a distal tip, the enlarged proximal end of the spike being disposed subjacent the distal tip such that a line of force extends from the distal end of the spike axially through the threaded rod and axially through the leg.

16. The reduced-slip mobility assisting device of claim 15 further comprising an alternate collar comprising a threaded internal bore adapted to receive the distal end of the threaded rod, said alternate collar comprising a rubber tip, the collar and the alternate collar being interchangeable on the threaded rod to alternately present a spike or a rubber tip.

17. The reduced-slip mobility assisting device of claim 1 further comprising an alternate collar comprising a threaded internal bore adapted to receive the distal end of the threaded rod, said alternate collar comprising a rubber tip, the collar and the alternate collar being interchangeable on the threaded rod to alternately present a pointed spike tip or a rubber tip.

18. The reduced-slip mobility assisting device of claim 15 wherein the spike is made of hardened steel, and the collar and the threaded rod are made of steel.

19. The reduced-slip mobility assisting device of claim 17 wherein the spike is made of hardened steel, and the collars and the threaded rod are made of steel.

20. The reduced-slip mobility assisting device of claim 15 further comprising a washer, said washer being disposed between the distal tip of the threaded rod and the enlarged proximal end of the spike.

* * * * *